United States Patent [19]

Warburg

[11] Patent Number: 4,683,782

[45] Date of Patent: Aug. 4, 1987

[54] MICROCENTRIFUGE TUBE OPENER

[76] Inventor: Richard J. Warburg, 43 Spruce Dr., Westwood, Mass. 02090

[21] Appl. No.: 931,710

[22] Filed: Nov. 17, 1986

[51] Int. Cl.[4] ..... B67B 7/00

[52] U.S. Cl. ..... 81/3.57

[58] Field of Search ..... 81/3.55, 3.57, 3.07; D8/18, 33, 40

[56] References Cited

U.S. PATENT DOCUMENTS 807,380 12/1905 Hicks ..... 81/3.57

FOREIGN PATENT DOCUMENTS 527306 10/1956 Belgium ..... 81/3.57
2508499 9/1976 Fed. Rep. of Germany ..... 81/3.55
2911086 10/1979 Fed. Rep. of Germany ..... 81/3.55
931226 2/1948 France ..... 81/3.57

*Primary Examiner*—Roscoe V. Parker
*Attorney, Agent, or Firm*—Richard J. Warburg

[57] ABSTRACT

A microcentrifuge tube opener adapted to open a microcentrifuge tube comprising a container with an opening, and a lid for the container, the lid having a lip projection extending past the outer perimeter of the opening and an inner portion shaped to sealing fit inside the opening. The opener comprises a base, having a recess shaped to accept the lip projection, comprising a lower projection below and adjacent the recess; and an upper projection above and adjacent the recess. Both the lower projection and the upper projection are positioned to touch the lid, but the base cannot touch the inner portion of the lid when the lid is removed from the cup and the lip is positioned in the recess. The lid can be moved from the cup by positioning the lip in the recess and causing the lower projection to apply pressure to the lip away from the cup and, at the same time, causing the upper projection to apply pressure to the tube at a position distant from the lip, in a direction towards the cup.

5 Claims, 4 Drawing Figures

FIG 1
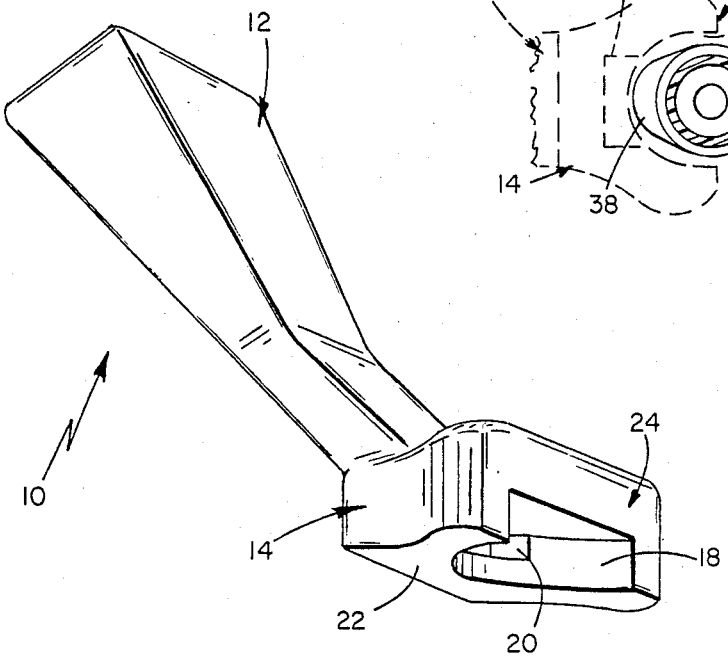
FIG 3
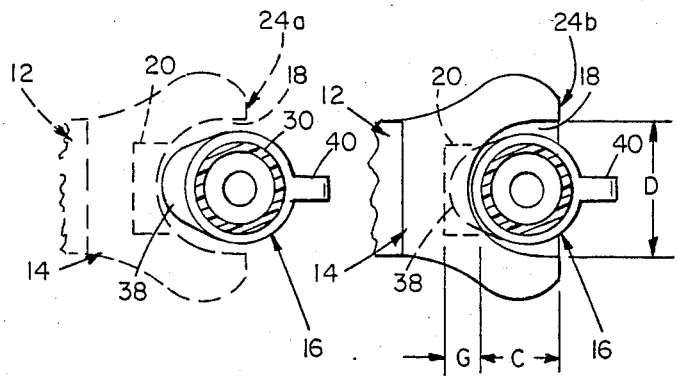
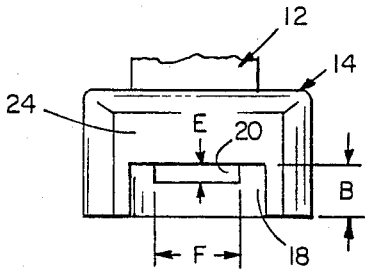
FIG 4
FIG 2
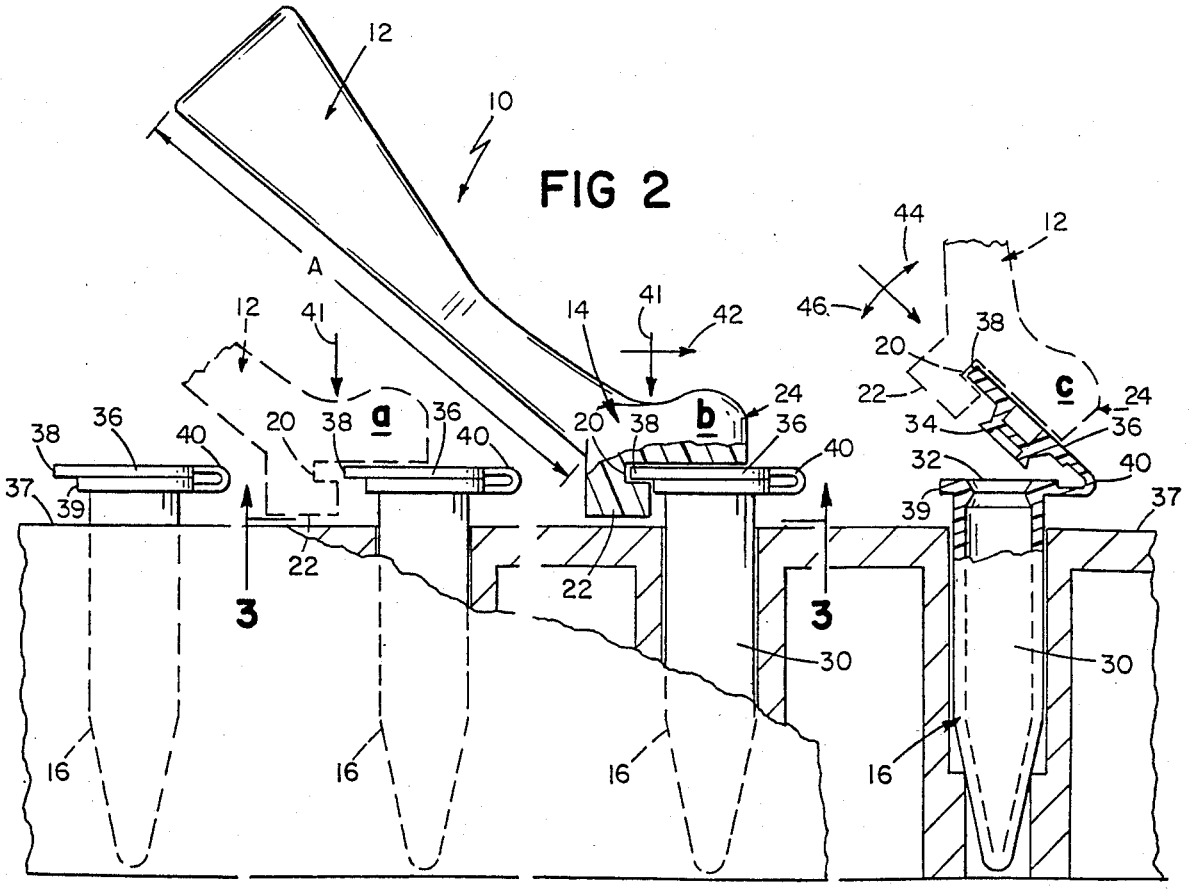

MICROCENTRIFUGE TUBE OPENER

BACKGROUND OF THE INVENTION

This invention relates to openers for microcentrifuge tubes.

Microcentrifuge tubes are small plastic tubes, generally capable of holding 0.4–1.7 $cm^3$ liquid. They are used widely in biotechnology laboratories for handling radioactively labelled chemicals, and as vessels for storing biochemicals, or for performing biochemical reactions. They have tightly fitting lids with a lip, an example of which is shown in the figures (labelled 36). Generally they are opened by pressing upward on the lip, using a thumb or a conventional beer bottle opener.

SUMMARY OF THE INVENTION

This invention features a microcentrifuge tube opener, and method of using the opener, adapted to open a microcentrifuge tube. The microcentrifuge tube comprises a container with an opening, and a lid for the container. The lid has a lip projection extending past the outer perimeter of the opening, and an inner portion shaped to sealing fit inside the opening. The opener comprises a base, having a recess shaped to accept the lip projection, comprising a lower projection attached to the base below and adjacent the recess, and an upper projection attached to the base above and adjacent the recess. Both the lower projection and the upper projection are positioned to touch the lid, however the opener cannot touch the inner portion of the lid when the lid is removed from the cup and the lip is positioned in the recess. Further, the lid can be moved from its position inside the cup by positioning the lip in the recess and causing the lower projection to apply pressure to the lip away from the cup and, at the same time causing the upper projection to apply pressure to the tube at a position distant from the lip in a direction toward the cup.

The opener of this invention permits the ready opening and closing of microcentrifuge tubes even when they have tightly fitting lids. It is important when using these tubes that the inner portion of the lid not be touched by anything which is non-sterile since the enzymes or other chemicals which are commonly present in such tubes are sensitive to contaminating agents (e.g. RNAases and proteases) present on either human fingers or articles touched by humans. In addition, some microcentrifuge tubes must be kept at a constant specific temperature (e.g., −20° C. or 0° C.) when they are are used for certain reactions, and it is useful to be able to open them quickly without altering these conditions.

The opener does not touch the inner portion of the lid and thus does not contaminate the contents of the tube. It allows quick opening of tubes, even when held in racks, thus permitting these tubes to be opened without disturbing the temperature of the tube. The opener can be used so that the lid does not fly open, but rather is gently removed from the tube. This prevents the formation of aerosols which occur when the pressure inside a tube is rapidly decreased and thus the contents become airborne. Such an occurence can be extremely dangerous when there is a radioactive solution in the tube; or when bacterial or viral solutions are present in the tube. Further, the opener does not distort or deform the shape of the lid during opening of the microcentrifuge tube.

Other features and advantages of the invention will be apparent from the following description of the preferred embodiment thereof and from the claims.

DESCRIPTION OF THE PREFERRED EMBODIMENT

The drawings will first briefly be described.

Drawings

FIG. 1 is a perspective view of an opener;

FIG. 2 is a sectional view of a series of microcentrifuge tubes and an opener;

FIG. 3 a plan view of the top of tubes and opener at 3—3 in FIG. 1 and FIG. 4 is a frontal view of the base of an opener.

STRUCTURE

Referring to the Figures, opener 10 has a handle 12, of length A, about 5 cm, and a base 14. Handle 12 is shaped to fit the contours of the under part of an index finger. Base 14 is shaped to fit snugly around a microcentrifuge tube 16, having a semi-oval shaped recess 18 (of depth B, about 0.5 cm; length C, about 1 cm; and width D, about 1 cm), and a largely rectangular recess 20 (of depth E, about 0.2 cm; width F, about 0.7 cm; and length G about 0.2 cm). Base 14 consists of a lower projection 22 below recess 20 and an upper projection 24 above recesses 18 and 20. Arm 24 also defines the sides of recesses 18 and 20 and is fused to lower projection 22.

Opener 10 is manufactured from a hard autoclavable plastic, such as acrylic, by standard procedures.

Use

Opener 10 is useful for opening microcentrifuge tubes having a lid with a lip projection, such as tube 16 having a lid 36 with lip 38 extending past the outer perimeter 39 of the tube, shown in the figures. Microcentrifuge tube 16 consists of a container 30 with an opening 32 in which an inner portion 34 of lid 36 fits snug. Lip projection 38 projects about 0.2 cm from the outer perimeter 39 of lid 36. Lid 36 is attached by a hinge 40 to container 30.

Referring to FIGS. 2, 3, in order to open a closed microcentrifuge tube 16 (FIG. 2*a*), held in a tube rack 37, opener 10 is positioned so that lip 38 of the tube 16 is facing toward recess 20 of the opener, and upper projection 24 is then pressed down as shown by arrow 41 onto lid 36. Opener 16 is then slid, as shown by arrow 42, towards lip 38 until lower projection 22 approaches the outer perimeter of container 30 (FIG. 2*b*). The two sides of upper projection 24 aid in making sure that lip 38 is positioned to enter recesses 18 and 20 in turn. When lip 38 is positioned inside recess 20, opener 16 is caused to turn, as shown by arrow 44, so that lower projection 22 exerts upward pressure on lip 38, and upper projection 24 exerts slight downward pressure on lid 36. In this way lid 36 is removed from opening 32 in container 30 (FIG. 2*c*). The microcentrifuge tube 16 may be closed by reversing this action, as shown by arrow 46, or by pressing it shut using a finger.

Opener 10 can be readily used when tube 16 is held in an operator's hand rather than in a rack 37. When a plurality of tubes 16 are held in a rack 37, as shown in FIG. 2, then opener 10 can be used to open each tube in turn without the other tubes interfering with the process.

Other Embodiments

Other embodiments are within the following claims. For example, handle 12 may be short and hollow to allow insertion of a finger into the handle.

I claim:

1. A microcentrifuge tube opener adapted to open a microcentrifuge tube comprising a container with an opening, and a lid for container, said lid having a lip projection extending past the outer perimeter of said opening, when said lid is placed above said opening, and a downwardly extending annular portion shaped to sealing fit inside said opening, said opener comprising:

a base, having a recess shaped to accept said lip projection, said base comprising:

a lower projection below and adjacent said recess, and an upper projection above and adjacent said recess, wherein said lower projection is positioned to engage said lip, and said upper projection is positioned to engage said lip and said lid and wherein said base cannot touch said annular portion of said lid when said lid is removed from said container and said lip is positioned in said recess, wherein said lid can be moved from said container by positioning said lip in said recess and causing said lower projection to apply pressure to said lip away from said container and, at the same time causing said upper projection to apply pressure to said lid at a position distant from said lip in direction towards said container.

2. The opener of claim 1 further comprising a handle attached to said base.

3. The opener of claim 2 wherein said upper projection extends further from said handle than said lower projection.

4. The opener of claim 1 wherein said lip projection projects from said lid a distance greater than the distance said recess extends into said base.

5. A method using an opener to open a microcentrifuge tube comprising a container with an opening, and a lid for said container, said lid having a lip projection extending past the outer perimeter of said opening, when said lid is placed above said opening, and a downwardly extending annular portion shaped to sealing fit inside said opening, said opener comprising:

a base having a recess shaped to accept said lip projection, said base comprising a lower projection below and adjacent said recess, and an upper projection above and adjacent said recess, wherein said lower projection is positioned to engage said lip, and said upper projection is positioned to engage said lip and said lid and wherein said base cannot touch said annular portion of said lid when said lid is removed from said container and said lip is positioned in said recess, said method comprising the steps of;

positioning said lip in said recess, causing said lower projection to apply pressure to said lip away from said container and, at the same time causing said upper projection to apply pressure to said tube at a position distant from said lip in a direction towards said container.

* * * * *